US007217157B2

(12) United States Patent
Onoda et al.

(10) Patent No.: US 7,217,157 B2
(45) Date of Patent: May 15, 2007

(54) WATERPROOF CONNECTOR

(75) Inventors: Katsuhiko Onoda, Shizuoka (JP); Takanori Suzuki, Shizuoka (JP); Masanobu Oishi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/339,544

(22) Filed: Jan. 26, 2006

(65) Prior Publication Data

US 2006/0189192 A1 Aug. 24, 2006

(30) Foreign Application Priority Data

Feb. 21, 2005 (JP) ..... P2005-044431

(51) Int. Cl.
*H01R 13/40* (2006.01)

(52) U.S. Cl. ..... 439/589; 439/587; 439/936; 439/901

(58) Field of Classification Search ..... 439/587, 439/589, 274, 275, 936, 901
See application file for complete search history.

(56) References Cited

U.S. PATENT DOCUMENTS 4,105,278 A * 8/1978 Braund et al. ..... 439/460
4,662,692 A * 5/1987 Uken et al. ..... 439/426
5,700,161 A * 12/1997 Plummer et al. ..... 439/587
5,735,697 A * 4/1998 Muzslay ..... 439/83
5,836,788 A * 11/1998 Torii ..... 439/587
5,934,934 A * 8/1999 Ward ..... 439/521
6,174,201 B1 * 1/2001 Murakami et al. ..... 439/587
6,676,447 B1 * 1/2004 Knox ..... 439/587
2002/0127912 A1 * 9/2002 Hamai et al. ..... 439/587

FOREIGN PATENT DOCUMENTS

JP 11-233225 A 8/1999

* cited by examiner

*Primary Examiner*—Hien Vu
(74) *Attorney, Agent, or Firm*—Sughrue Mion, PLLC

(57) ABSTRACT

In a waterproof connector, a sealing material is filled in an internal space of an outer housing which lies between an inner housing and a waterproof plug. The outer housing is so formed that a centerline of a connector opening and a centerline of a waterproof plug receiving portion are offset a predetermined amount from each other, and the density of wires in the sealing material-filling space within the outer housing is made generally uniform.

6 Claims, 7 Drawing Sheets

WATERPROOF CONNECTOR

BACKGROUND OF THE INVENTION

Field of the Invention

This invention relates to a waterproof connector designed to meet a multi-pole design (due to the use of an increased number of circuits) and the use of terminals of different sizes (for a power system and a signal system), and more particularly to a structure for enhancing the ability to fill a sealing material in a connector housing.

There are already known various waterproof connectors (see, for example, JP-A-11-233225 Publication).

In a conventional waterproof connector, many wires pass through an internal space (hereinafter referred to as "sealing material-filling space") of an outer housing in which the sealing material is filled. Particularly, a larger number of wires, extending respectively from the signal-system small terminals disposed at one side of the internal, pass through the one-side space as compared with the other-side space through which the power-system large terminals (disposed at the other-side of the internal) pass.

Therefore, there has been encountered a problem that the sealing material cannot be satisfactorily filled in the space through which the wires (extending respectively from the signal-system small terminals) pass.

And besides, the sealing material is filled in the sealing material-filling space by inserting the filling nozzle into the less densely-occupied space through which the wires, extending respectively from the power-system large terminals, pass.

Therefore, the filling of the sealing material in the space through which the wires (extending respectively from the signal-system small terminals) pass is effected after the filling of the sealing material in the space through which the wires (extending respectively from the power-system large terminals) pass is effected. Therefore, the sealing material-filling ability is worsened, and this has invited a problem that unfilled portions and residual bubbles develop.

SUMMARY OF THE INVENTION

This invention has been made in view of the above circumstances, and an object of the invention is to provide a waterproof connector in which the density of wires in an internal space of an outer housing, filled with a sealing material, is prevented from becoming uneven so that a sealing material can be filled uniformly in between the wires within the space, thereby enhancing the ability to fill the sealing material in the space.

(1) The invention provides a waterproof connector comprising:

an outer housing having an internal space, a first opening on a first side thereof and a second opening on a second side thereof;

an inner housing having a first and second areas in which different kinds of terminals are mounted, the inner housing being fitted to the first opening of the outer housing;

a waterproof plug through which a plurality of wires connected to the terminals pass in a sealing manner, the waterproof plug being fitted to the second opening;

a sealing material filled in the internal space of the outer housing between the inner housing and the waterproof plug;

wherein a centerline of the first opening and a centerline of the second opening are offset a predetermined amount from each other so that a density of the wires is made generally uniform in the internal space of the outer housing.

(2) The first opening may have a larger area than the second opening.

(3) An inclined surface may be formed on a predetermined portion of an inner surface of the outer housing in the internal space so as to oppose to the inner housing.

(4) The inclined surface may be formed on the second side of the outer housing.

In this waterproof connector, the outer housing is so formed that the centerline of the first opening and the centerline of the second opening are offset a predetermined amount from each other, and with this construction, the density of the wires in the internal space of the outer housing, filled with the sealing material, is made uniform, and there can be obtained the waterproof connector in which the ability to fill the sealing material in the space, as well as the efficiency of the filling operation, is excellent.

(5) A communication hole communicating the first opening of the outer housing with the internal space may be formed in the first area of the inner housing in which large-size terminals are mounted, and when the sealing material is filled in the internal space, a filling nozzle for supplying the sealing material may be inserted into the internal space through the communication hole.

(6) An inclined surface may be formed on a predetermined portion of an inner surface of the outer housing in the internal space so as to oppose to the inner housing, and when the sealing material is filled in the internal space, the inclined surface may guide the sealing material from a filling nozzle inserted into the internal space through a communication hole formed in the inner housing.

In this waterproof connector, the filling nozzle for supplying the sealing material is inserted from the first opening of the outer housing into the space through the communication hole formed in the area of the inner housing in which the large-size terminals are mounted. Therefore, there can be obtained the waterproof connector in which the ability to fill the sealing material in the space, as well as the efficiency of the filling operation, is further enhanced.

(7) A guide groove may be formed in the inner surface of the outer housing over an entire periphery of the internal space, and when the sealing material is filled in the internal space, the sealing material may flow into the guide groove via the inclined surface; and a plurality of notches may be formed in the guide groove portion, and may be disposed at predetermined intervals along the periphery of the guide groove, and the sealing material may be flowed from the guide groove via the notches toward the second side of said internal space.

In this waterproof connector, the inclined surface, the guide groove and the notches are provided in the sealing material-filling space within the outer housing, and therefore there can be obtained the waterproof connector in which the ability to smoothly and positively fill the sealing material from the filling nozzle in the space, as well as the ability to uniformly fill the sealing material, is secured.

In the waterproof connector of the present invention, the density of the wires in the sealing material-filling space within the outer housing can be made more uniform, and therefore the excellent ability to fill the sealing material in the space, as well as the high efficiency of the filling operation, can be secured.

DETAILED DESCRIPTION OF THE PREFERRED EMBODIMENTS

Figure 6:
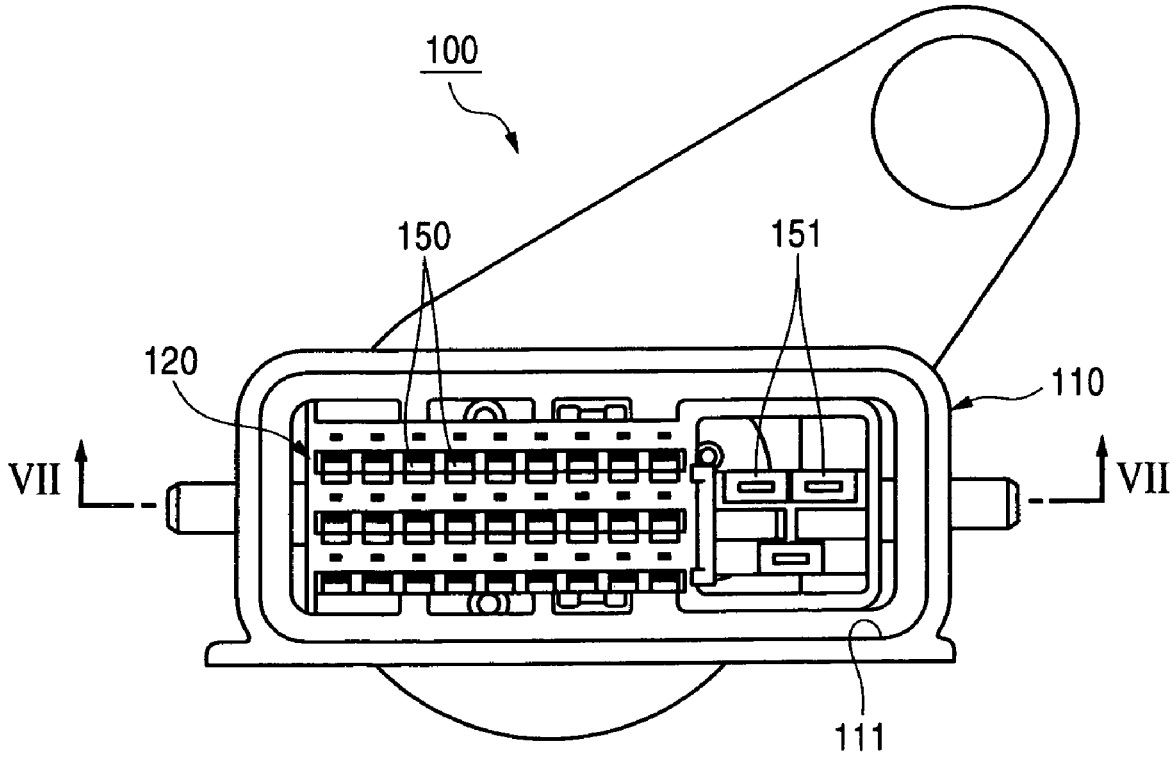
FIG. 6 is a plan view of a related-art waterproof connector.
Figure 7:
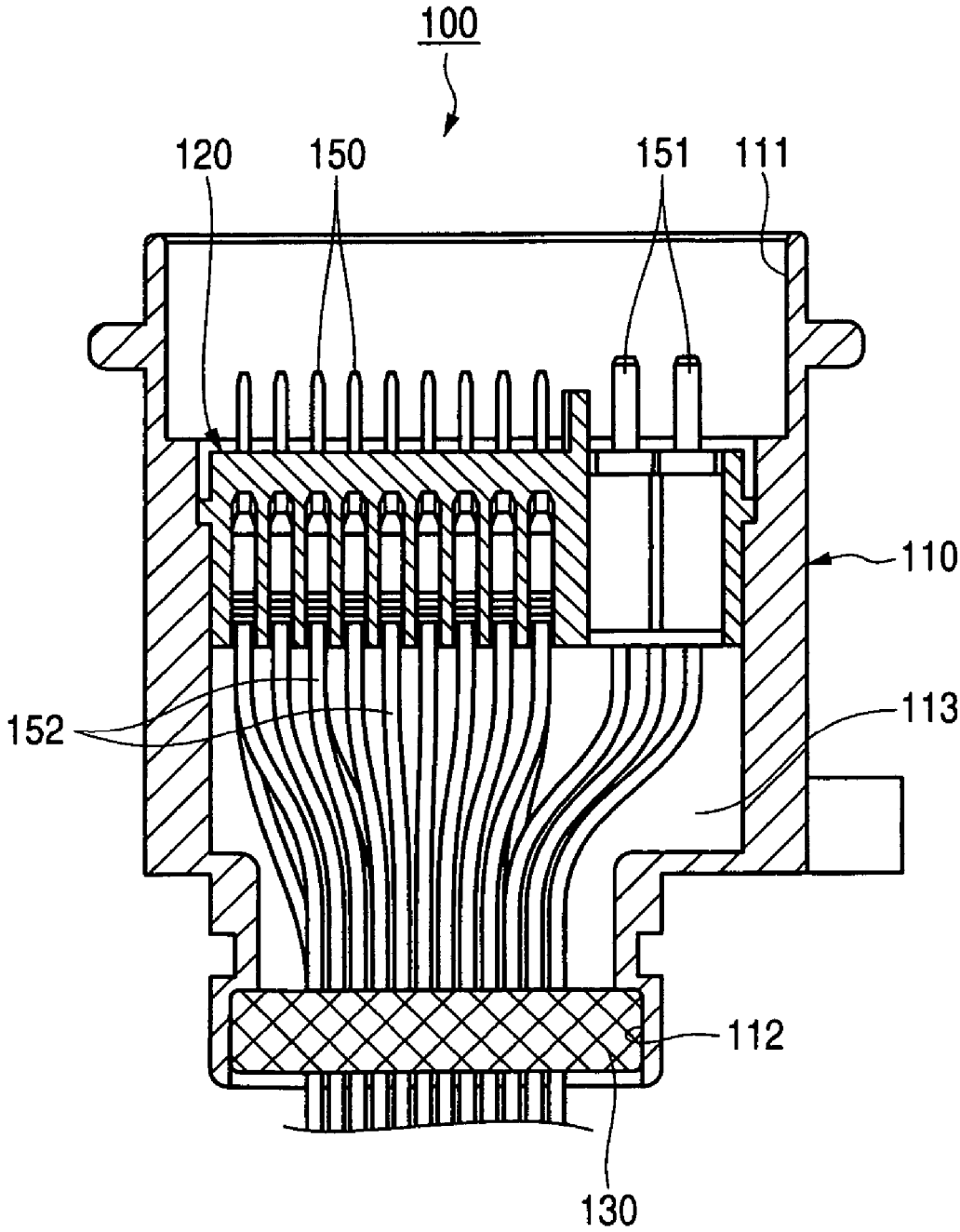
FIG. 7 is a cross-sectional view of the waterproof connector taken along the line VII—VII of FIG. 6.

FIG. 6 is a plan view of a related art waterproof connector that is developed previously from the claimed invention, and FIG. 7 is a cross-sectional view of the waterproof connector taken along the line VII—VII of FIG. 6.

In the waterproof connector 100, a sealing material (not shown) is filled in an internal space of an outer housing 110 lying between an inner housing 120 and a waterproof plug 130, as shown in FIGS. 6 and 7.

The outer housing 110 has a connector opening 111 formed in one end portion thereof (upper portion in FIG. 7), and also has a waterproof plug receiving portion 112 formed in the other end portion thereof (lower portion in FIG. 7). The inner housing 120 is provided in the connector opening 111 of the outer housing 110, and a plurality of kinds of terminals 150 and 151 of different sizes are mounted in an assorted manner in different areas of the inner housing 120 according to their size. Namely, the small-size terminals 150 for a signal system are mounted in the left-side area (FIG. 7) disposed generally at the left side of a centerline of the inner housing 120, while the large-size terminals 151 for a power system are mounted in the right area (FIG. 7) disposed at the right side of the centerline of the inner housing 120.

The waterproof plug 130 is fitted in the waterproof plug receiving portion 112 in the outer housing 110, and wires 152, extending respectively from the terminals 150 and 151 (mounted in the inner housing 120) toward the waterproof plug receiving portion 112 within the outer housing 110, pass through the waterproof plug 130 to the exterior of the outer housing 110. With the use of a filling nozzle (not shown), the sealing material is filled in the internal space of the outer housing 110 which lies between the inner housing 120 and the waterproof plug 130 and through which the wires 152 pass.

A preferred embodiment of the present invention will now be described with reference to the drawings.

Figure 1:
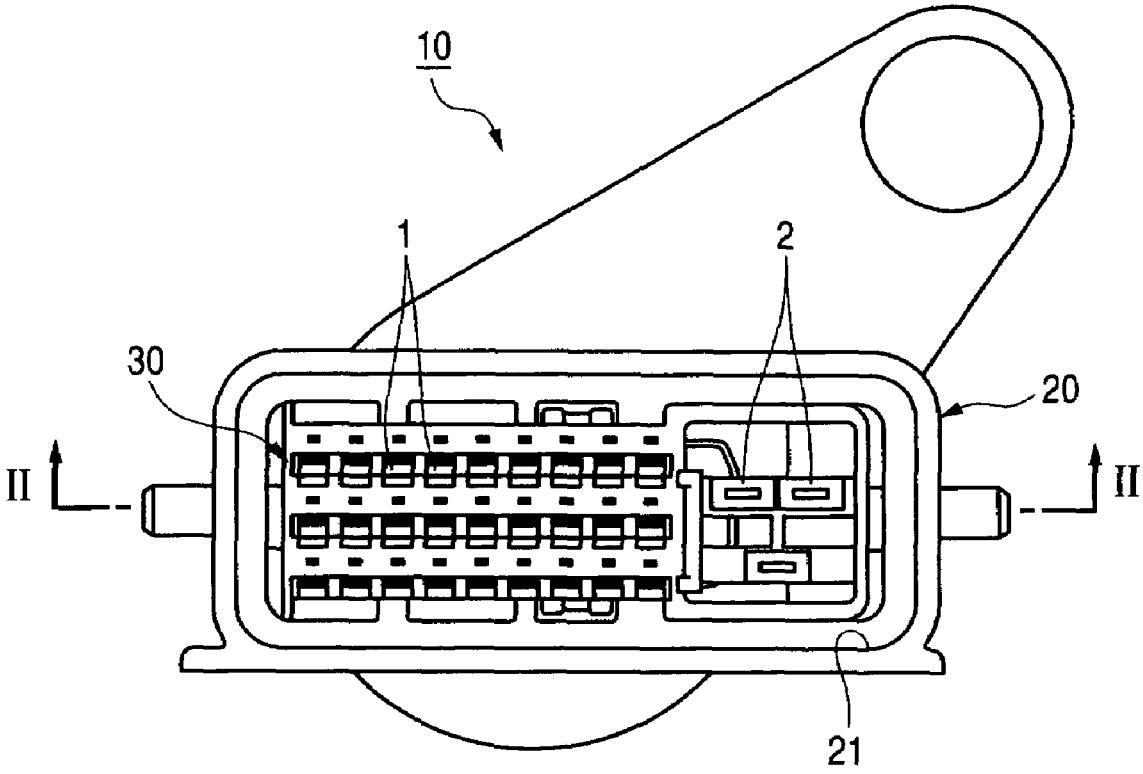
FIG. 1 is a plan view of a first embodiment of a waterproof connector of the present invention.
Figure 2:
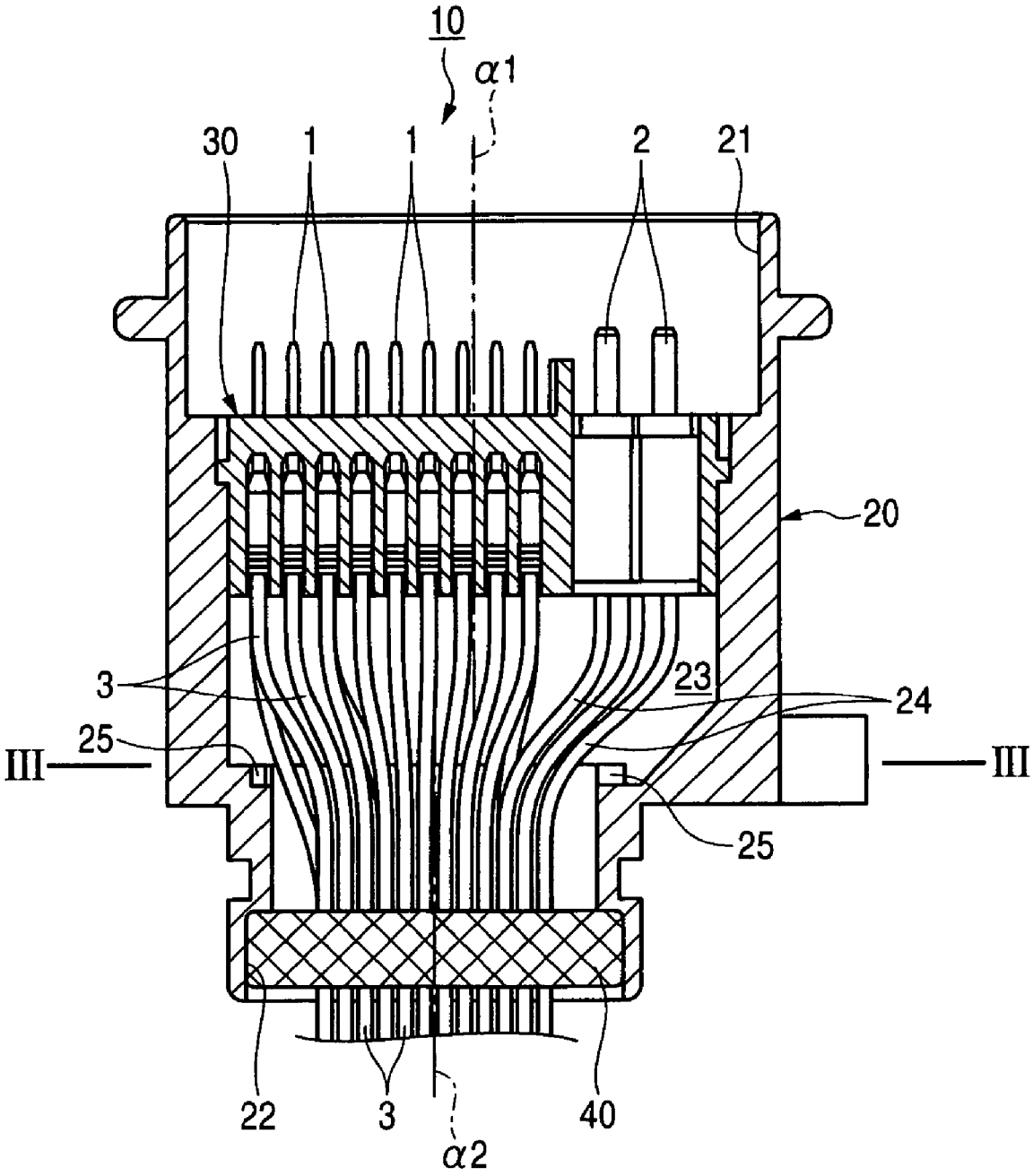
FIG. 2 is a cross-sectional view taken along the line II—II of FIG. 1, showing a condition before a sealing material is filled in the waterproof connector of FIG. 1.
Figure 3:
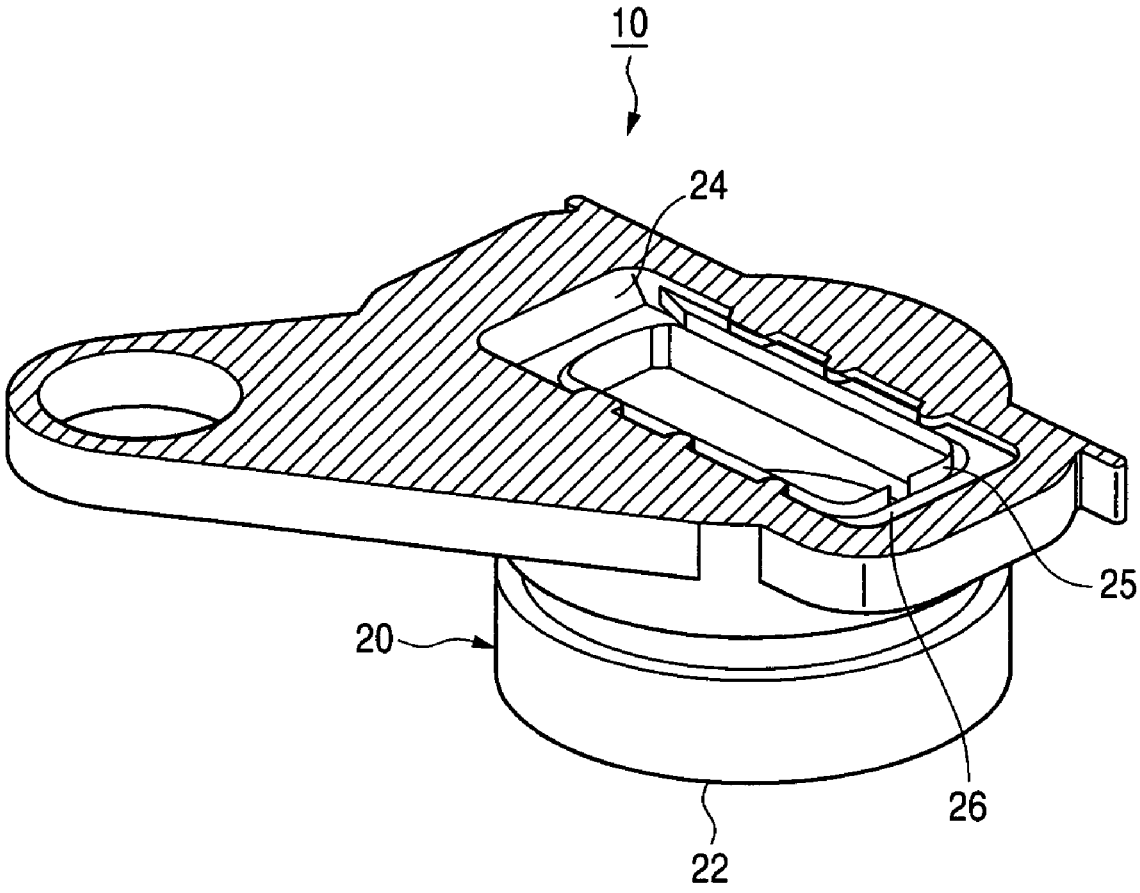
FIG. 3 is a perspective view of the waterproof connector of FIG. 1 cut along the line III—III of FIG. 2.
Figure 4:
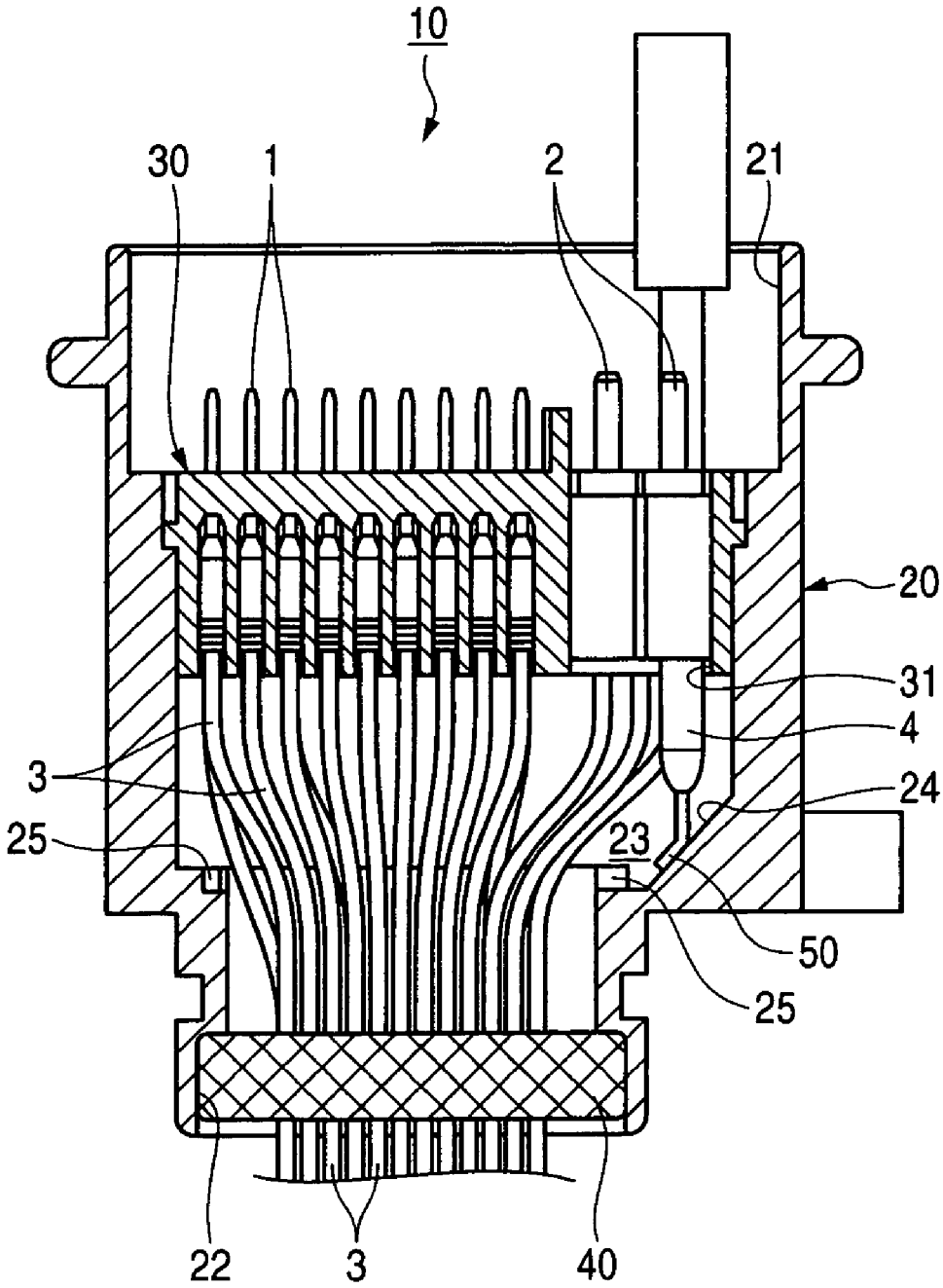
FIG. 4 is a cross-sectional view taken along the line II—II in FIG. 1, showing a sealing material-filling operation in which a filling nozzle is inserted into the waterproof connector of FIG. 2.
Figure 5:
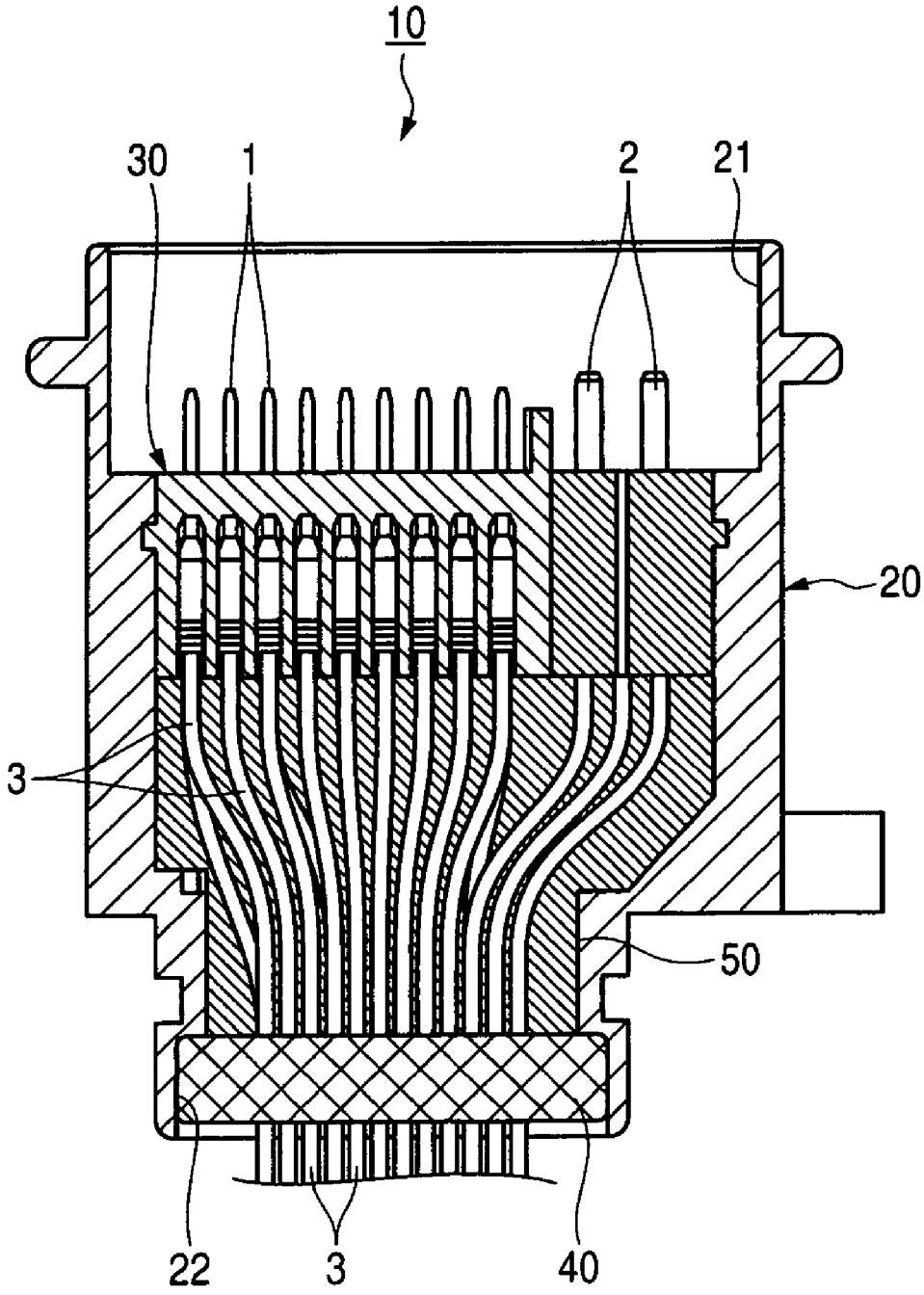
FIG. 5 is a cross-sectional view taken along the line II—II in FIG. 1, showing a condition after the sealing material is filled in the waterproof connector of FIG. 4.

FIG. 1 is a plan view of the first embodiment of a waterproof connector of the invention, FIG. 2 is a cross-sectional view taken along the line II—II of FIG. 1, showing a condition before a sealing material is filled in the waterproof connector of FIG. 1, FIG. 3 is a perspective view of the waterproof connector of FIG. 1 cut along the line III—III of FIG. 2, FIG. 4 is a cross-sectional view taken along the line II—II, showing a sealing material-filling operation in which a filling nozzle is inserted into the waterproof connector of FIG. 2, and FIG. 5 is a cross-sectional view taken along the line II—II, showing a condition after the sealing material is filled in the waterproof connector of FIG. 4.

Referring to FIGS. 1 to 5, in the waterproof connector 10, the sealing material 50 (see FIG. 5) is filled in an internal space of an outer housing 20 lying between an inner housing 30 and a waterproof plug 40.

The outer housing 20 has a connector opening 21 (first opening of the invention) formed in one end portion thereof (upper portion in FIG. 2), and also has a waterproof plug receiving portion 22 (second opening of the invention) formed in the other end portion thereof (lower portion in FIG. 2).

The inner housing 30 is provided in the connector opening 21 of the outer housing 20, and a plurality of kinds of terminals 1 and 2 of different sizes are mounted in an assorted manner in different areas of the inner housing 30 according to their size. Namely, the small-size terminals 1 for a signal system (hereinafter referred to as "signal-system small terminals") are mounted in the left-side area (FIG. 2) disposed generally at the left side of a centerline of the inner housing 30, while the large-size terminals 2 for a power system (hereinafter referred to as "power-system large terminals") are mounted in the right area (FIG. 7) disposed at the right side of the centerline of the inner housing 30.

The waterproof plug 40 is fitted in the waterproof plug receiving portion 22 in the outer housing 20, and wires 3, extending respectively from the terminals 1 and 2 (mounted in the inner housing 30) toward the waterproof plug receiving portion 22 (that is, downward in FIG. 2) within the outer housing 20, pass through the waterproof plug 40 to the exterior of the outer housing 20.

With the use of the filling nozzle 4 (FIG. 4), the sealing material 50 is filled in the internal space of the outer housing 20 which lies between the inner housing 30 and the waterproof plug 40 and through which the wires 3 pass.

The outer housing 20 is so formed that a centerline $\alpha 1$ of the connector opening 21 and a centerline $\alpha 2$ of the waterproof plug receiving portion 22 are offset a predetermined amount from each other. Because of this offset arrangement, the centerline of the inner housing 30, provided in the connector opening 21, and a centerline of the waterproof plug 40, fitted in the waterproof plug receiving portion 22, are offset from each other by an amount equal to the above offset amount in the same direction as the direction of offset of the centerlines $\alpha 1$ and $\alpha 2$. With this construction, the density of the wires 3 in the space (hereinafter referred to as "sealing material-filling space 23") to be filled with the sealing material 50 is made generally uniform.

A filling guide surface 24 (inclined surface of the invention) is formed on a predetermined portion of an inner surface of the outer housing 20 exposed to the sealing material-filling space 23. When the sealing material 50 is poured into the sealing material-filling space 23, the filling guide surface 24 receives the sealing material 50 from the filling nozzle 4 inserted into the sealing material-filling space 23 through a communication hole 31 (described later) formed in the inner housing 30.

Further, a guide groove 25 is formed in the inner surface of the outer housing 20 over an entire periphery of the sealing material-filling space 23. When the sealing material 50 is poured into the sealing material-filling space 23, the sealing material 50 flows into the guide groove 25 via the filling guide surface 24.

A plurality of notches 26 are formed in the guide groove portion 25, and are disposed at predetermined intervals in the direction of the periphery of the guide groove 25. The sealing material 50, poured from the filling nozzle 4 into the guide groove 25 via the filling guide surface 24, is flowed from the guide groove 25 via the notches 26 toward that portion of the sealing material-filling space 23 disposed close to the waterproof plug 40 (that is, downward in FIG. 2).

The communication hole 31, communicating the connector opening 21 of the outer housing 20 with the sealing material-filling space 23, is formed in the area of the inner housing 30 in which the power-system large terminals 2 are mounted. When the sealing material 50 is to be filled in the sealing material-filling space 23, the filling nozzle 4 for supplying the sealing material 50 is inserted from the connector opening 21 of the outer housing 20 into the sealing material-filling space 23 through the communication hole 31 (that is, inserted downward from the upper side in FIG. 2).

Next, the operation of this embodiment will be described.

In the above waterproof connector 10, when the sealing material 50 is to be filled in the sealing material-filling space 23, the filling nozzle 4 is inserted from the connector opening 21 of the outer housing 20 into the sealing material-filling space 23 through the communication hole 31 (that is, inserted downward from the upper side in FIG. 4) in the inner housing 30, as shown in FIG. 4. In this condition, the sealing material 50, supplied from the filling nozzle 4, is smoothly and positively filled in the sealing material-filling space 23 via the filling guide surface 24, the guide groove 25 and the notches 26 in the guide groove portion 25.

Namely, the sealing material 50 from the filling nozzle 4 flows into the guide groove 25 via the filling guide surface 24, and is filled in this guide groove 25 over the entire periphery thereof, and thereafter the sealing material 50 drops through the notches 26 of the guide groove portion 25 into that portion (lower portion in FIG. 2) of the sealing material-filling space 23 disposed close to the waterproof plug 40. Then, the sealing material 50 is uniformly filled in the sealing material-filling space 23 in such a manner that the level of this filled sealing material 50 gradually rises from the upper surface of the waterproof plug 40.

Here, the density of the wires 3 in the sealing material-filling space 23 is generally uniform since the centerline $\alpha 1$ of the connector opening 21 of the outer housing 20 and the centerline $\alpha 2$ of the waterproof plug receiving portion 22 are offset from each other. Therefore, in the above filling operation, the sealing material 50 is uniformly filled in between the wires 3 within the sealing material-filling space 23. As a result, the enhanced ability to fill the sealing material 50 in the sealing material-filling space 23 is secured.

As described above, in the above embodiment, the density of the wires 3 in the sealing material-filling space 23 within the outer housing 20 can be prevented from becoming uneven, and the sealing material 50 can be filled uniformly in between the wires 3 within the sealing material-filling space 23. Therefore, the ability to fill the sealing material 50 in the sealing material-filling space 23, as well as the efficiency of the filling operation, can be enhanced, and the development of unfilled portions and residual bubbles can be suppressed. And besides, the efficiency of the operation for passing the wires through the waterproof plug 40 can be enhanced.

Furthermore, the communication hole 31 in the inner housing 30 is provided in the area where the power-system large terminals 2 are mounted, that is, the less densely-occupied area as compared with the area where the signal-system small terminals 1 are mounted. Therefore, the efficiency of the operation for filling the sealing material 50 in the sealing material-filling space 23 can be further enhanced, and also the sealing material 50 can be filled more uniformly in between the wires 3 within the sealing material-filling space 23.

Furthermore, the filling guide surface 24, the guide groove 25 and the notches 26 are provided in the sealing material-filling space 23 within the outer housing 20, and therefore the sealing material 50 from the filling nozzle 4 can be positively flowed into the guide groove 25 via the filling guide surface 24, and can be smoothly flowed via the notches 25 into that portion of the sealing material-filling space 23 disposed close to the waterproof plug 40. Therefore, the ability to smoothly and positively fill the sealing material 50 from the filling nozzle 4 in the sealing material-filling space 23, as well as the ability to uniformly fill the sealing material, can be secured. Therefore, the sealing material 50 can be filled more uniformly in between the wires 3 within the sealing material-filling space 23, and also the efficiency of the operation for filling the sealing material 50 in the sealing material-filling space 23 can be further enhanced.

The waterproof connector of the present invention can be suitably used as a waterproof connector designed to meet a multi-pole design (due to the use of an increased number of circuits) and the use of terminals of different sizes (for a power system and a signal system), and more particularly the structure of the invention can be suitably used at those portions of such a waterproof connector requiring a waterproof ability.

What is claimed is:

1. A waterproof connector comprising:

an outer housing having an internal space, a first opening on a first side thereof and a second opening on a second side thereof;

an inner housing having a first and second areas in which different kinds of terminals are mounted, said inner housing being fitted to said first opening of said outer housing;

a waterproof plug through which a plurality of wires connected to said terminals pass in a sealing manner, said waterproof plug being fitted to said second opening;

a sealing material filled in said internal space of said outer housing between said inner housing and said waterproof plug;

wherein a centerline of said first opening and a centerline of said second opening are offset a predetermined amount from each other so that a density of said wires is made generally uniform in said internal space of said outer housing, wherein an inclined surface is formed on a predetermined portion of an inner surface of said outer housing in said internal space so as to oppose to said inner housing and wherein said inclined surface tapers towards said centerline of said first opening.

2. A waterproof connector according to claim 1, wherein said first opening has a larger area than said second opening.

3. A waterproof connector according to claim 1, wherein said inclined surface is formed on the second side of the outer housing.

4. A waterproof connector according to claim 1, wherein a communication hole communicating said first opening of said outer housing with said internal space is formed in the first area of said inner housing in which large-size terminals are mounted, and when the sealing material is filled in said internal space, a filling nozzle for supplying said sealing material is inserted into said internal space through said communication hole.

5. A waterproof connector according to claim 1, when the sealing material is filled in said internal space, said inclined surface guides the sealing material from a filling nozzle inserted into said internal space through a communication hole formed in said inner housing.

6. A waterproof connector comprising:

an outer housing having an internal space, a first opening on a first side thereof and a second opening on a second side thereof;

an inner housing having a first and second areas in which different kinds of terminals are mounted, said inner housing being fitted to said first opening of said outer housing;

a waterproof plug through which a plurality of wires connected to said terminals pass in a sealing manner, said waterproof plug being fitted to said second opening;

a sealing material filled in said internal space of said outer housing between said inner housing and said waterproof plug;

wherein a centerline of said first opening and a centerline of said second opening are offset a predetermined amount from each other so that a density of said wires is made generally uniform in said internal space of said outer, wherein an inclined surface is formed on a predetermined portion of an inner surface of said outer housing in said internal space so as to oppose to said inner housing, and when the sealing material is filled in said internal space, said inclined surface guides the sealing material from a filling nozzle inserted into said internal space through a communication hole formed in said inner housing, wherein a guide groove is formed in the inner surface of said outer housing over an entire periphery of said internal space, and when the sealing material is filled in said internal space, the sealing material flows into said guide groove via said inclined surface; and a plurality of notches are formed in said guide groove at predetermined intervals along the periphery of said guide groove, and the sealing material is flowed from said guide groove via said notches toward the second side of said internal space.

* * * * *